US007487627B2

(12) United States Patent
Godoy

(10) Patent No.: US 7,487,627 B2
(45) Date of Patent: Feb. 10, 2009

(54) SLANT MOUNT STIRRUP

(76) Inventor: Joseph Godoy, 34565 W. Eclipse Rd., Stanfield, AZ (US) 85272

( * ) Notice: Subject to any disclaimer, the term of this patent is extended or adjusted under 35 U.S.C. 154(b) by 244 days.

(21) Appl. No.: 11/377,137

(22) Filed: Mar. 15, 2006

(65) Prior Publication Data

US 2007/0214753 A1 Sep. 20, 2007

(51) Int. Cl.
*B68C 3/00* (2006.01)

(52) U.S. Cl. ..... 54/47; D30/142

(58) Field of Classification Search ..... 54/47, 54/48, 49, 49.5; D30/142
See application file for complete search history.

(56) References Cited

U.S. PATENT DOCUMENTS

| | | | | | |
|---|---|---|---|---|---|
| 453,607 | A | * | 6/1891 | Baker | 54/47 |
| D29,415 | S | * | 9/1898 | Bantz | D30/142 |
| 1,520,586 | A | * | 12/1924 | McCamis | 54/49 |
| D108,285 | S | * | 2/1938 | Hart | D30/142 |
| D318,936 | S | | 8/1991 | Rabeck | |
| 5,398,488 | A | * | 3/1995 | Brown | 54/47 |
| D411,667 | S | | 6/1999 | Martin | |
| 5,979,149 | A | | 11/1999 | Martin | |
| D429,389 | S | | 8/2000 | Bostock | |
| 6,334,291 | B1 | | 1/2002 | Lelievre | |
| 6,425,230 | B2 | | 7/2002 | Vollmecke et al. | |
| 6,651,409 | B2 | | 11/2003 | Jones | |

* cited by examiner

*Primary Examiner*—Rob Swiatek
(74) *Attorney, Agent, or Firm*—Gene Scott; Patent Law & Venture Group

(57) ABSTRACT

A combination apparatus comprises stirrup leathers engaged with a pair of stirrups, each of the stirrups providing a support bar; a pair of spaced apart stirrup sides; and a linear foot rest. The foot rest and the support bar are fastened between the stirrup sides with the foot rest and support bar spaced apart for admitting a riding boot resting on the foot rest. The support bar provides a symmetrically positioned longitudinal axis oriented in parallel with the foot rest. The support bar is configured with a diminishing thickness between its ends. The diminishing thickness of the support bars is of such magnitude as to position the foot rests in a horizontal attitude when the apparatus is mounted on a horse and the stirrups are engaged by the boots of a rider.

7 Claims, 2 Drawing Sheets

SLANT MOUNT STIRRUP

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPPENDIX"

Not applicable.

BACKGROUND OF THE INVENTION

1. Field of the Present Disclosure

This disclosure relates generally to equestrian stirrups and particularly to a stirrup that affords a more comfortable position for the rider's foot.

2. Description of Related Art Including Information Disclosed Under 37 CFR 1.97 and 1.98

Martin, US Des. 411667; Bostock, Des. 429389 and Rabeck, Des. 318930 each discloses a design for a stirrup. Vollmecke et al, U.S. Pat. No. 6,425,230 discloses a stirrup having a crossbar that supports a rider's shoe in riding. The stirrup further has an upper portion that is provided with a fastener for a carrying belt of the stirrup. The stirrup also has a damping body, which is arranged on the stirrup between the crossbar and the rider's shoe. Lelievre, U.S. Pat. No. 6,334,291, discloses a stirrup for horseback riding formed by two branches connected to the ends of a bearing support (tread) for the foot of the rider mounted pivotable about an axis connecting the two branches, characterized in that the bearing support (3) is also mounted with a possibility of vertical or substantially vertical movement relative to the branches (2) of the stirrup (1). The stirrup can be used in the field of horseback riding, in particular for facilitating teaching or practice of horseback riding. Martin, U.S. Pat. No. 5,979,149 discloses a stainless steel stirrup with a rotatable foot plate pivotally connected to the lower ends of the stirrup limbs and including means for restricting the forward rotation of the stirrup to a substantially horizontal position with respect to the stirrup limbs but allowing the stirrup to rotate freely in a backward direction through a range of approximately 90. degree. Jones, U.S. Pat. No. 6,651,409 discloses a riding stirrup (10) including a hanger rod (11) for connecting the stirrup to a saddle, and a stirrup loop (12) connected to the hanger rod. The stirrup loop (12) defines a stirrup opening (14) through which a rider may extend their foot when the rider is sitting in the saddle. The stirrup loop (12) also includes an elongated base support tread (17) positioned generally at the bottom of the loop. The base support tread (17) extends at a slant with respect to a stirrup centerline (CL) which extends perpendicular to the longitudinal axis of the hanger rod (11), through a midpoint of the rod, and through the base support tread. This slant places the distance between an outer tread section (21) and the hanger rod (11) greater than the distance between an inner tread section (20) and the hanger rod.

Our prior art search with abstracts described above teaches a variety of equestrian stirrups; i.e., various designs and different structures. However, the prior art fails to teach a stirrup that is able to be supported in stirrup leathers at a more natural angle so that the riders' ankle does not tire easily. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A combination apparatus comprising stirrup leathers engaged with a pair of stirrups, each of the stirrups providing a support bar; a pair of spaced apart stirrup sides; and a linear foot rest. The foot rest and the support bar are fastened between the stirrup sides with the foot rest and support bar spaced apart for admitting a riding boot resting on the foot rest. The support bar provides a symmetrically positioned longitudinal axis oriented in parallel with the foot rest. The support bar is configured with a diminishing thickness between its ends. The diminishing thickness of the support bars is of such magnitude as to position the foot rests in a horizontal attitude when the apparatus is mounted on a horse and the stirrups are engaged by the boots of a rider.

A primary objective inherent in the above described apparatus and method of use is to provide advantages not taught by the prior art.

Another objective is to provide a stirrup that sits within its stirrup leathers as a more natural angle.

A further objective is to provide such a stirrup that is inexpensive to manufacture and of light weight and yet rugged structure.

Other features and advantages of the described apparatus and method of use will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 3:
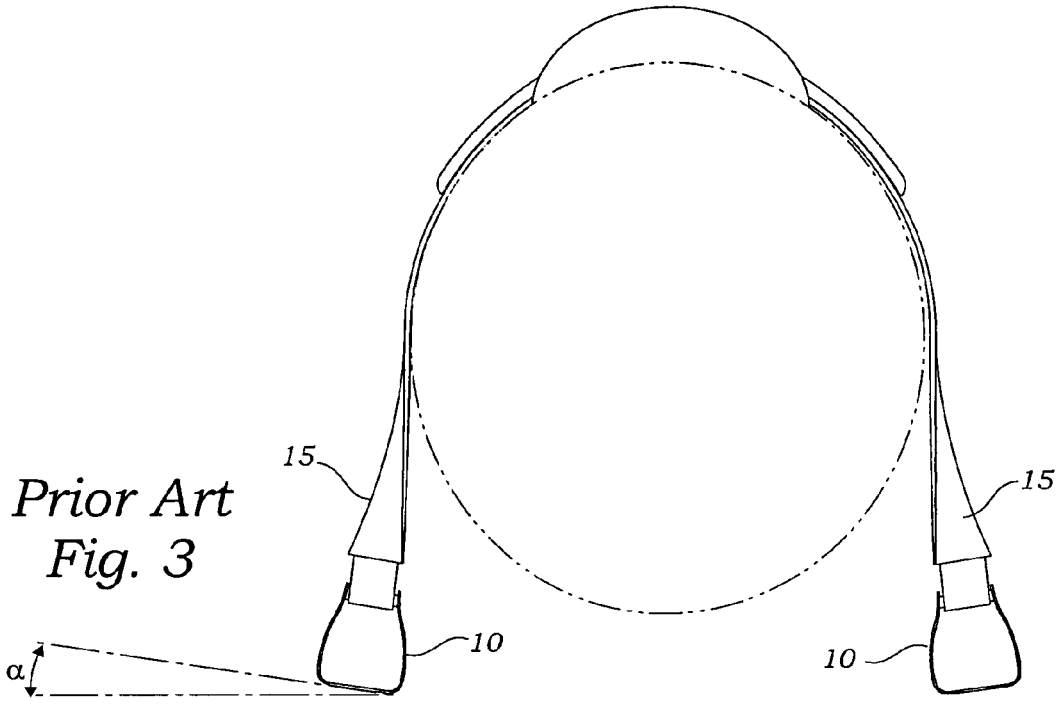
Prior Art Fig. 3
FIG. 3 is an elevational view of the prior art.
Figure 4:
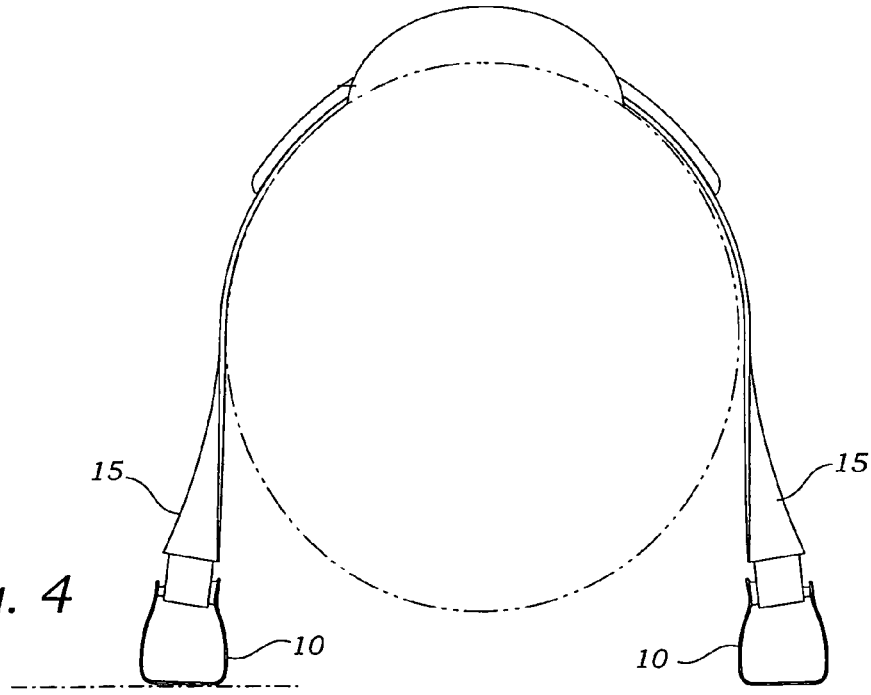
FIG. 4 is an elevational view similar to FIG. 3 showing the apparatus as mounted in stirrup leathers on a horse.

The presently described apparatus is a stirrup 10 for mounting in stirrup leathers 15. In use, two of the presently described stirrups 10 are mounted on either side of a horse in the stirrup leathers 15 for providing improved riding comfort to the rider by affording a more natural orientation of the rider's boots, i.e., the boots are positioned in the stirrups such that the feet of the rider are not canted to one side or the other (bent angles). As can be seen in FIGS. 3 and 4, the normal attitude of the stirrup leathers is to extend downwardly and away from the horse. When the leathers and stirrups are rotated into the position shown in FIGS. 3 and 4, the foot rest 18 of the stirrup sits at an angle $\alpha$ with respect to the horizontal. The boot of a rider and the ankle of the rider is therefore flexed outwardly by the same angle. As shown in FIG. 4, the present invention enables the rider's ankle to assume a more natural upright position with respect to the horizontal with the sole of the riding boot essentially horizontal.

Figure 1:
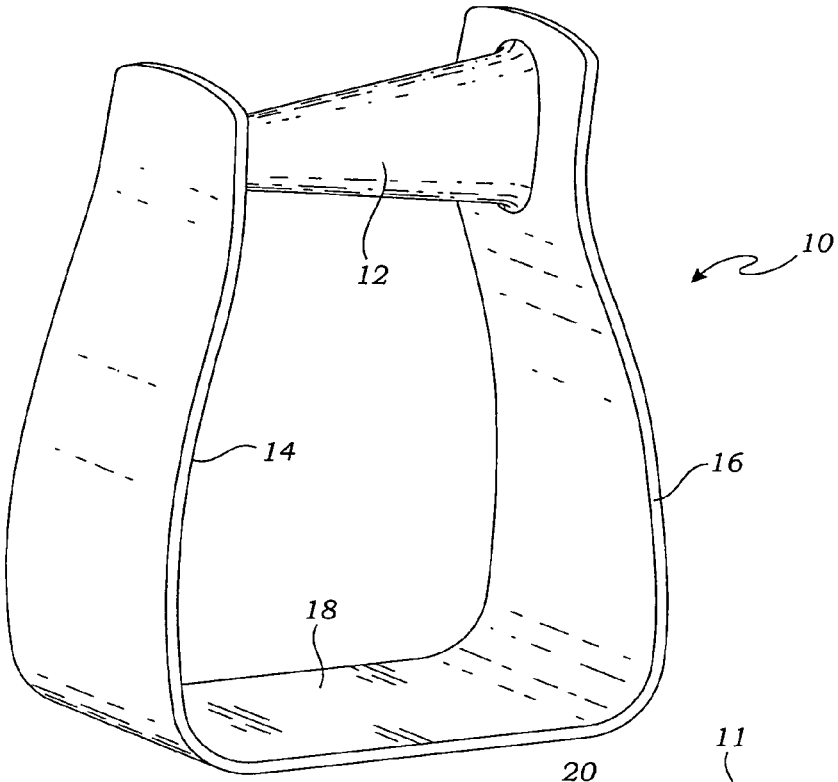
FIG. 1 is a perspective view the apparatus.

The stirrups 10 are preferably made of a rigid structural material such as aluminum or steel. Referring now to FIG. 1, each stirrup 10 provides a support bar 12, a pair of spaced apart stirrup sides 14 and 16, and the linear foot rest 18. In this disclosure as well as the claims we shall refer to the stirrup 10 as it appears in FIGS. 1 and 2, which are frontal elevational views, so that the vertical and horizontal senses are clearly understood. The foot rest 18 is horizontal in these figures and the sides 14 and 16 are oriented vertically. The symmetrical center line 20 of the support bar 12 is horizontal so that it is parallel to the foot rest 18. The foot rest 18 and the support bar 12 are fastened between, or integral with the stirrup sides 14 and 16 with the foot rest 18 and support bar 12 spaced apart for admitting a riding boot, not shown, therebetween with the riding boot resting on the foot rest 18 as is well known in the art.

Figure 2:
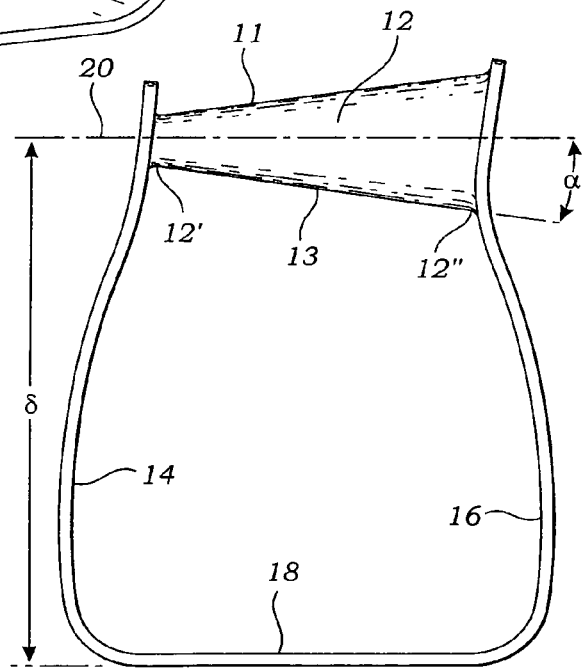
FIG. 2 is a frontal elevational view thereof.

As shown in FIG. 2 axis 20 and rest 18 are spaced apart by dimension $\delta$ which is a constant across the width of the stirrup. The support bar 12 is preferably configured with a diminishing vertical height between its ends 12' and 12" and preferably its surface is uniformly diminishing, that is, upper or top edge 11 and lower or bottom edge 13 are straight lines as shown.

Preferably, the stirrup sides 14 and 16, and the foot rest 18 are formed from a single strip of metal taking-on an approximately U-shaped conformation as is shown. However, the sides 14, 16 and the foot rest 18 need not be constructed in this manner in order to meet the objectives of the present apparatus.

The horizontal thickness of the support bar 12 may be invariant or not, but it is preferably invariant as this provides an improved coupling between the bar 12 and the leathers 15.

The variation in height of support bar 12 is of such magnitude as to position the foot rests 18 in a horizontal attitude when the apparatus is mounted in stirrup leathers 15 on a horse and the stirrups 10 are engaged by the boots of a rider. To accomplish this, the angle between the bottom edge 13 of the support bar 12 and the longitudinal axis 20 is preferably of the magnitude $\alpha$. It is the lower surface 13 that engages the stirrup leathers and therefore is determinant as to the resultant angle of the foot support 18 and the riding boot that rests upon it.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A stirrup apparatus comprising: a support bar; a pair of spaced apart stirrup sides; and a foot rest; the foot rest and the support bar fastened between the stirrup sides with the foot rest and support bar spaced apart by a distance allowing a riding boot therebetween to rest on the foot rest; the support bar having a symmetrically positioned longitudinal axis, the longitudinal axis oriented in parallel with the foot rest; a top edge of the support bar configured linearly between the stirrup sides; a bottom edge of the support bar configured linearly between the stirrup sides; the top edge and the bottom edge of the support bar mutually uniformly and continuously divergent between the stirrup sides, from one side to the other side.

2. The apparatus of claim 1 wherein the stirrup sides and the foot rest are formed from a single strip of metal formed essentially into a U-shape.

3. The apparatus of claim 1 wherein the angle between the linearly configured bottom edge and the longitudinal axis is of a magnitude to position the foot rest in a horizontal attitude when the apparatus is mounted in stirrup leathers and engaged by a boot of a rider.

4. A combination apparatus comprising: stirrup leathers engaged with a pair of stirrups, each of the stirrups providing a support bar; a pair of spaced apart stirrup sides; and a linear foot rest; the foot rest and the support bar fastened between the stirrup sides with the foot rest and support bar spaced apart by a distance allowing a riding boot therebetween to rest on the foot rest; the support bar having a symmetrically positioned longitudinal axis, the longitudinal axis oriented in parallel with the foot rest; a top edge of the support bar configured linearly between the stirrup sides; a bottom edge of the support bar configures linearly between the stirrup sides; the top edge and the bottom edge of the support bar mutually uniformly and continuously divergent between the stirrup sides, from one side to the other side.

5. The apparatus of claim 4 wherein in each of the stirrups, the stirrup sides and the foot rest are formed from a single strip of metal taking-on an approximately U-shaped conformation.

6. The apparatus of claim 4 wherein the angle between the linearly configured bottom edge and the longitudinal axis is of a magnitude to position the foot rests in a horizontal attitude when the apparatus is mounted on a horse and the stirrups are engaged by the boots of a rider.

7. A stirrup apparatus comprising: a support bar; a pair of spaced apart stirrup sides; and a foot rest; the foot rest and the support bar fastened between the stirrup sides with the foot rest and support bar spaced apart by a distance allowing a riding boot therebetween to rest on the foot rest; the support bar having a longitudinal axis oriented in parallel with the foot rest; a bottom edge of the support bar configured linearly and continuously between the stirrup sides, from one side to the other side, and oriented at a selected angle greater than zero relative to the longitudinal axis, the selected angle enabling the foot rest to assume a horizontal attitude when the stirrup apparatus is mounted in stirrup leathers held at the selected angle.

* * * * *